United States Patent [19]

Broerman

[11] Patent Number: 4,930,705

[45] Date of Patent: Jun. 5, 1990

[54] AIR FLOW APPARATUS

[75] Inventor: Steven E. Broerman, Mason, Ohio

[73] Assignee: Vortec Corporation, Cincinnati, Ohio

[21] Appl. No.: 310,741

[22] Filed: Feb. 14, 1989

[51] Int. Cl.[5] ..... B05B 1/04

[52] U.S. Cl. ..... 239/590.5; 239/597

[58] Field of Search ..... 239/590, 590.5, 597, 239/461; 137/[illegible]; 251/127

[56] References Cited

U.S. PATENT DOCUMENTS

| | | | |
|---|---|---|---|
| 2,558,238 | 6/1951 | Collins | 239/461 |
| 3,360,202 | 12/1967 | Taylor et al. | 239/597 |
| 3,878,991 | 4/1975 | Sabadics et al. | 239/597 |
| 4,046,492 | 9/1977 | Inglis | 417/197 |

OTHER PUBLICATIONS

1988 Brauer Catalog.

Exair Catalog.

Exxair Corp. literature.

*Primary Examiner*—Andres Kashnikow

*Assistant Examiner*—Karen B. Merritt

*Attorney, Agent, or Firm*—Tilton, Fallon, Lungmus & Chestnut

[57] ABSTRACT

An air flow apparatus for providing a continuous curtain of jetting fluid includes a body member defining: an elongate plenum chamber for receiving compressed fluid; at least one inlet opening; and an outlet opening or nozzle for discharging fluid from the plenum chamber. The apparatus also includes an elongate baffle disposed in the plenum chamber, longitudinally of the plenum chamber, between the inlet opening and the nozzle for isolating turbulence in the fluid when the fluid enters the plenum chamber without restricting the flow of the fluid.

12 Claims, 1 Drawing Sheet

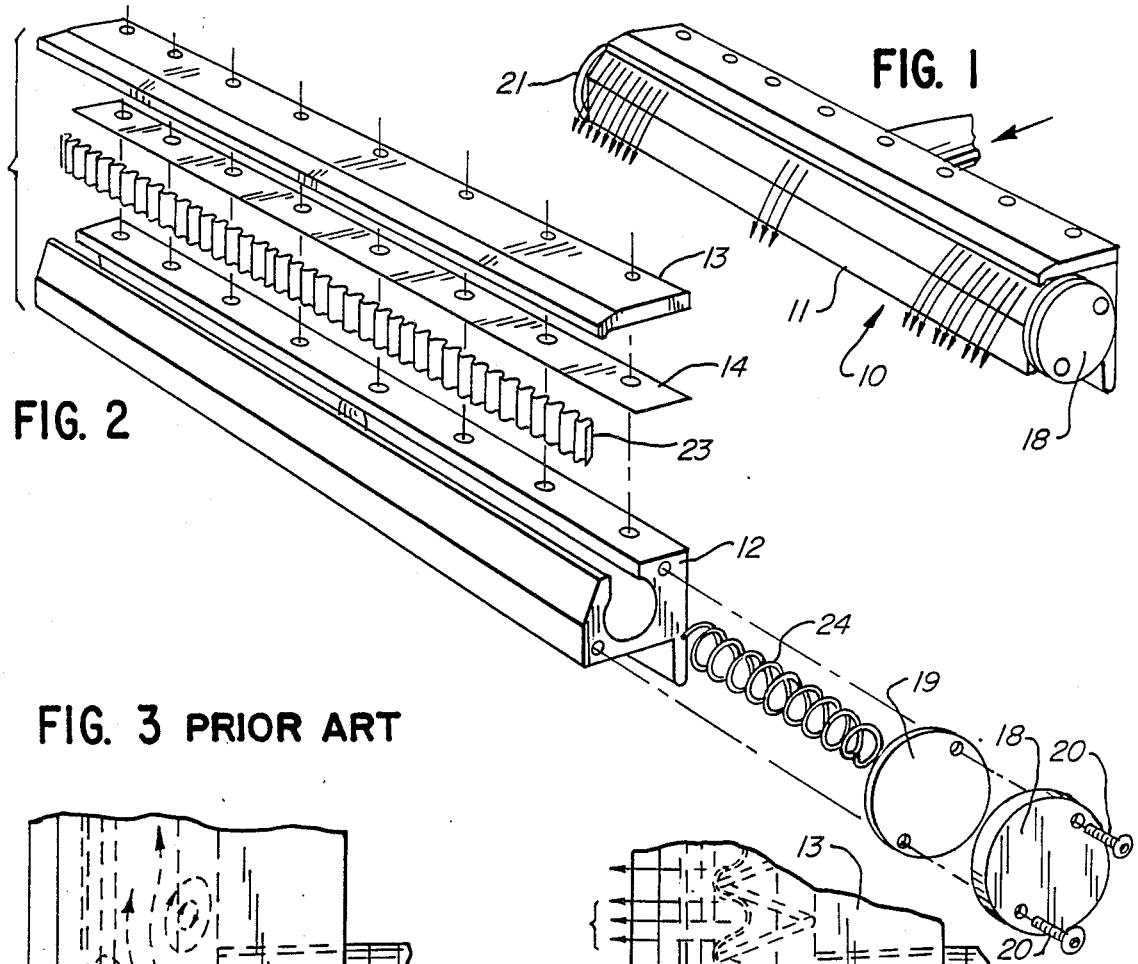
FIG. 1
FIG. 2
FIG. 3 PRIOR ART
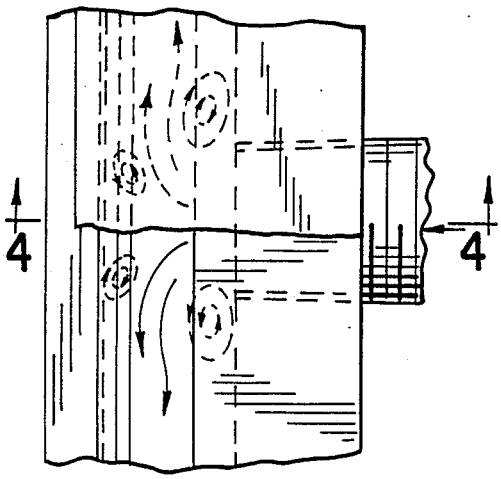
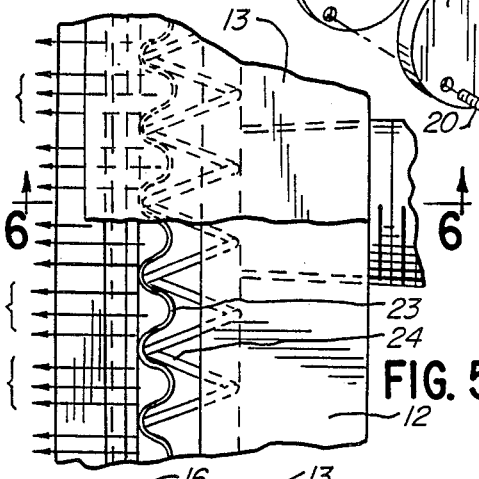
FIG. 5
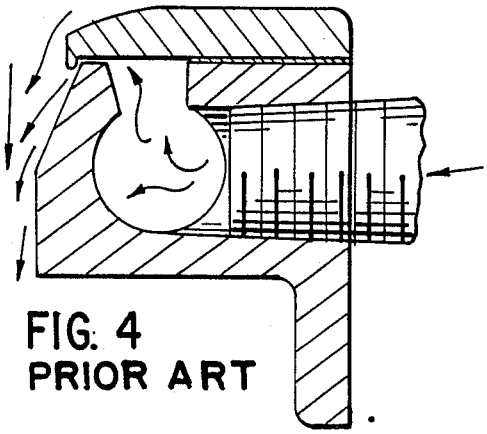
FIG. 4
PRIOR ART
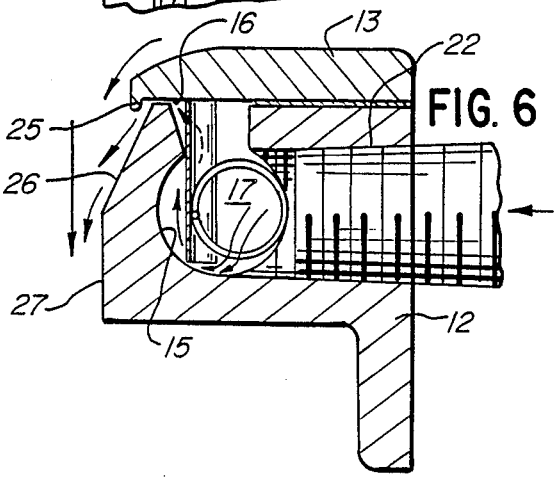
FIG. 6

AIR FLOW APPARATUS

BACKGROUND OF THE INVENTION

1. Field Of The Invention

The present invention relates generally to an air flow apparatus and, more specifically, to an air flow apparatus which provides a thin and continuous layer of jetting fluid.

2. Description Of The Prior Art

Inglis U.S. Pat. No. 4,046,492, which issued Sept. 6, 1977, discloses an air flow amplifier. This amplifier includes an annular nozzle for producing a column of jetting fluid. A similar prior device known as a curtain transvector provides a thin layer or curtain of jetting fluid. It has a linear nozzle for producing this curtain of fluid.

A curtain transvector includes a body member which defines: an elongate plenum chamber; at least one inlet providing communication between the plenum chamber and a compressed air source; and a linear outlet or nozzle which restricts the pressurized air flowing out of the plenum chamber and produces a thin film of jetting air. The inlet is a round opening whose center lies normal to the longitudinal axis of the plenum chamber.

A great number of curtain transvector applications require a flat, continuous curtain of fluid without any discontinuities. Many prior art transvectors do not meet this requirement. The air curtains they provide includes low pressure zones or "dead spots". This occurs for the following reasons:

Compressed air enters the plenum chambers of these prior devices, flowing in a direction perpendicular to the longitudinal axis of the plenum chamber. The air flow at the inlet is highly turbulent because the air must change direction abruptly to flow into the chamber and because the air expands rapidly when it enters the plenum. This turbulence produces the low pressure zones.

To solve this problem, one prior device includes an inlet at one or both ends of an elongate plenum chamber. In this device, the air flows into the plenum chamber without having to change its direction of flow. This device, however, increases the overall length of the unit whereby a smaller percentage of usable length is available to provide the curtain of air. This increased overall length precludes its application where the device must conform to cramped mounting locations. In addition, standard pipe fittings installed at one or both ends of the plenum chamber, significantly increase the overall length of the device, and, substantially reduce the percentage of usable length available.

The air flow apparatus of the present invention provides a mechanism which includes a baffle member disposed in the plenum chamber to isolate the turbulence and distribute and regulate air flow evenly to the linear nozzle of the apparatus. It provides a construction which minimizes the expense of manufacture and assembly and gives precise uniform and reliable performance. The air flow apparatus of the present invention comprises a small number of components which provide a continuous curtain of jetting fluid.

SUMMARY OF THE INVENTION

In accordance with one embodiment of this invention, an air flow apparatus includes an elongate body member made of metal or any other material with high strength and rigidity. This member defines an elongate plenum chamber for receiving compressed fluid, e.g., air. It also defines at least one inlet opening through which the plenum chamber receives the compressed fluid from a source.

In addition, the body member defines an outlet opening or nozzle through which the plenum chamber discharges the fluid. This outlet opening restricts the flow of air, increasing the velocity of the fluid as it discharges and allowing the discharging fluid to entrain significant amounts of ambient or secondary air.

A baffle disposed in the plenum chamber between the inlet and the nozzle suppresses any turbulence in the fluid which enters the plenum chamber, and it distributes and regulates the air flow evenly to the nozzle. However, it does not restrict the flow of the fluid in the chamber. In the preferred embodiment, the baffle is a corrugated metal member which divides the plenum chamber into two portions having varying cross-sectional areas. The fluid flows into the plenum chamber and engages the baffle. Then it flows along the corrugations of the baffle to the nozzle through which it discharges.

The baffle lies upright and extends along the length of the plenum chamber. When the apparatus receives fluid, the fluid moves the baffle to a predetermined position where it performs its intended function. To prevent movement or "rattling" of the baffle during handling or when the apparatus is not in operation, a spring disposed in the plenum chamber secures the baffle in the predetermined position. This spring is a coil spring which has a pitch that allows its coils to extend into the corrugations of the baffle. It lies between the walls of the plenum and baffle.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 1 is a perspective view of a preferred embodiment of an air flow apparatus embodying the present invention.

FIG. 2 is an exploded perspective view of the apparatus of the present invention.

FIG. 3 is a partial plan view of a prior art air curtain transvector with the top segment of the main body member cut away to show the plenum chamber and the flow of fluid inside the plenum chamber.

FIG. 4 is a sectional view taken along line 4—4 in FIG. 3.

FIG. 5 is a partial top plan view of the apparatus of the present invention with the top segment of the main body member cut away to show the plenum chamber with a baffle and spring disposed in the plenum chamber.

FIG. 6 is a sectional view taken along line 6—6 in FIG. 5.

While the applicant will describe the invention in connection with a preferred embodiment, one should understand that the invention is not limited to this embodiment. Furthermore, one should understand that the drawings are not necessarily to scale. In certain instances, the applicant may have omitted details which are not necessary for an understanding of the present invention.

DETAILED DESCRIPTION OF THE DRAWINGS AND A PREFERRED EMBODIMENT

Turning now to the drawings, FIG. 1 shows the preferred embodiment of an air flow apparatus generally at 10. The apparatus includes a main body member 11 with a base member 12 and a cap member 13. The members 12 and 13 are elongate and made of metal or any other suitable material of high strength and rigidity. Bolts secure the cap member 13 to the base member 12; and a shim 14, disposed between the members 12 and 13 determines the size of the thickness of a linear slit 16 (See discussion below) defined by the members 12 and 13. The shim 14 is a strip of metal foil or any other suitable material.

The base member 12 has an elongate opening 15 formed though it. This opening 15 has an inverted bulb-like shape and an open top. The cap member 13 closes the top of this opening except for the slit 16. Thus, the members 12 and 13 define an elongate plenum chamber 17 disposed along the entire length of the main body member 11.

A circular metal plate 18 and a gasket 19 secured to one end of the base member 12 with bolts 20 close the plenum chamber 17 at that end. Similarly, a circular metal plate 21 and a gasket (not shown) secured to the opposite end of the base member 12 with bolts (also not shown) close the chamber 17 at the opposite end.

The base member 12 has an inlet 22 through which the plenum chamber 17 receives compressed fluid, e.g., air. This inlet opening 22 is threaded to receive a fitting or any other suitable connector which provides fluid communication with a source of compressed fluid (not shown). Alternatively, the base member 12 may include two or more inlet openings for the plenum chamber.

The inlet opening 22 extends perpendicularly to the longitudinal axis of the plenum chamber. Thus, when compressed fluid flows into the plenum chamber, its direction of flow changes. This change in direction of flow of the fluid creates turbulence at the inlet opening. In addition, the sudden expansion of the fluid when it enters into the plenum chamber also creates turbulence. In prior devices, this turbulence creates discontinuities in the curtain of fluid which flows out through slit 16.

To suppress this turbulence and provide a continuous curtain of fluid, the apparatus 10 includes a baffle 23 which is an elongate piece of corrugated metal or any other material of high strength and rigidity. This baffle 23 extends along the entire length of the plenum chamber 17. It lies upright in the plenum chamber as shown in FIG. 6 and its corrugations provide flow channels for the fluid to flow downward and upward in moving toward the slit 16.

The baffle moves to the position shown in FIG. 6 (to the left-hand side of the plenum chamber 17) under the force of the compressed fluid which flows in the plenum chamber 17. It "finds" this position without manipulation or setting by the user. In this location, it can effectively suppress the turbulence and distribute the fluid throughout the plenum chamber 17.

To prevent moving or "rattling" of the baffle during handling and installation, the apparatus 10 includes a coil spring 24 disposed in the plenum chamber 17 between the baffle 23 and the rear wall of the plenum to secure the baffle in the position shown in FIG. 6. The spring has a pitch which allows its coils to extend into the corrugations of the baffle. This spring may extend along the entire length of the plenum chamber 17. Alternatively, the apparatus 10 may include a number of shorter springs disposed along the plenum chamber or one small spring disposed in any desired location.

In operation, the apparatus 10 receives compressed fluid, and turbulent flow occurs. The baffle 23, however, prevents direct communication of the turbulence with the slit 16. It forces the fluid to travel along the length of the plenum chamber 17 and along its corrugations or feeder channels. It suppresses the turbulence without restricting the flow of the fluid; and the air flows to the slit 16.

The slit or passage 16 is of substantially uniform width throughout its length. It defines a nozzle which restricts the flow of fluid. Thus, the fluid discharges from this nozzle at a velocity substantially greater than the velocity at which it enters the plenum chamber. Moreover, the configuration of the main body member 11 around the nozzle 16 further amplifies the discharge of the fluid. This structure includes a lip 25 which is an extension of cap member 13.

In operation, the lip 25 deflects the fluid discharging from the nozzle 16 onto an angled surface 26 of the base member 12. Here, the fluid entrains secondary fluid or air. Further entrainment of the secondary air occurs as the primary fluid travels along the face 27 of the base member 12. Eventually, at the bottom end of face 27, the high velocity fluid detaches and continues to flow along the same plane as the surface 27. Once the fluid detachment occurs, the fluid has two surfaces which entrain additional secondary air. Inglis U.S. Pat. No. 4,046,492 describes the amplification which occurs at the nozzle 16; and the applicant incorporates the disclosure of that patent to the present disclosure by this reference.

Thus, the applicant has provided an air flow apparatus capable of providing a continuous layer of jetting fluid. While the applicant has shown one embodiment of the invention, one will understand, of course, that the invention is not limited to this embodiment since those skilled in the art to which the invention pertains may make modifications and other embodiments of the principals of the invention, particularly upon considering the foregoing teachings. The applicant, therefore, by the appended claims, intends to cover any modifications and other embodiments and incorporate those features which constitute the essential features of this invention.

What is claimed is:

1. An apparatus for providing a thin, continuous film of jetting fluid, said apparatus comprising:

(a) An elongate body member defining: an elongate plenum chamber for receiving compressed fluid; inlet opening means for providing fluid communication between the plenum chamber and the outside of the body member, said plenum chamber receiving compressed fluid through said inlet opening means; and outlet opening means for providing fluid communication between the plenum chamber and the outside of the body member, said plenum chamber discharging the fluid through said outlet opening means, said outlet opening means restricting the flow of the fluid as it discharges;

(b) an elongate baffle disposed in the plenum chamber in unsecured relation to the body member, longitudinally of the plenum chamber, between the inlet opening means and the outlet opening means, for isolating turbulence in the fluid when the fluid enters the plenum chamber without restricting the flow of the fluid, said baffle moving against and engaging the body member in response to the force of the compressed fluid.

2. The apparatus of claim 1 wherein said baffle defines passageway means disposed transversely of said baffle for directing the pressurized fluid around the baffle.

3. The apparatus of claim 2 wherein said baffle extends across the entire length of the plenum chamber.

4. The apparatus of claim 3 wherein said baffle is a corrugated member.

5. The apparatus of claim 1 further comprising securing means for restricting the movement of said baffle when the apparatus is not in operation.

6. The apparatus of claim 5 wherein said securing means is at least one coil spring disposed longitudinally of said plenum chamber between the baffle and a wall of the chamber.

7. An improved apparatus for providing a thin continuous film of jetting fluid, said apparatus having an elongate body member defining: an elongate plenum chamber for receiving compressed fluid; inlet opening means for providing fluid communication between the plenum chamber and the outside of the body member, said plenum chamber receiving fluid through said inlet opening means; and outlet opening means for providing fluid communication between the plenum chamber and the outside of the body member, said plenum chamber discharging fluid through said outlet opening means, said outlet opening means restricting the flow of the fluid as it discharges, wherein the improvement comprises: an elongate baffle disposed in the plenum chamber in unsecured relation to the body member, longitudinally of the plenum chamber, between the inlet opening means and the outlet opening means, for isolating turbulence in the fluid when the fluid enters the plenum chamber without restricting the flow of the fluid, said baffle moving against and engaging the body member in response to the force of the compressed fluid.

8. The apparatus of claim 7 wherein said baffle includes passageway means disposed transversely of said baffle for directing the pressurized fluid around the baffle.

9. The apparatus of claim 8 wherein said baffle extends across the entire length of the plenum chamber.

10. The apparatus of claim 9 wherein said baffle is a corrugated member.

11. The apparatus of claim 7 further comprising securing means for securing said baffle in a predetermined position.

12. The apparatus of claim 11 wherein said securing means is at least one coil spring disposed longitudinally of said plenum chamber between the baffle and a wall of the chamber.

* * * * *